US008070322B2

(12) United States Patent
Unsworth

(10) Patent No.: US 8,070,322 B2
(45) Date of Patent: Dec. 6, 2011

(54) EXAMINATION LIGHT WITH READILY ACCESSIBLE CONTROLS

(75) Inventor: Austin Unsworth, Fort Mill, SC (US)

(73) Assignee: Dental Equipment, LLC, Charlotte, NC (US)

( * ) Notice: Subject to any disclaimer, the term of this patent is extended or adjusted under 35 U.S.C. 154(b) by 541 days.

(21) Appl. No.: 12/209,041

(22) Filed: Sep. 11, 2008

(65) Prior Publication Data

US 2010/0062388 A1 Mar. 11, 2010

(51) Int. Cl.
*F21S 8/00* (2006.01)

(52) U.S. Cl. ..... 362/285; 362/85

(58) Field of Classification Search ..... 362/285, 362/573, 572, 804; 600/249, 248, 245–247; 433/29, 30

See application file for complete search history.

(56) References Cited

U.S. PATENT DOCUMENTS

| | | | | |
|---|---|---|---|---|
| 3,191,023 | A * | 6/1965 | Jones et al. | 362/220 |
| 4,930,058 | A | 5/1990 | Jones et al. | |
| 5,165,786 | A * | 11/1992 | Hubert | 362/287 |
| 6,863,422 | B2 * | 3/2005 | Jesurun et al. | 362/399 |

* cited by examiner

*Primary Examiner* — Sharon Payne
(74) *Attorney, Agent, or Firm* — Timothy H. Van Dyke; Beusse, Wolter, Sanks, Mora & Maire, P.A.

(57) ABSTRACT

Disclosed herein are examination light embodiments. A light having a frame for holding the light has a frontal support member with first and second lateral sides. Disposed on each first and lateral sides are one or more actuators for controlling functionality of the light. A first and second handle are associated with the first and second lateral sides, respectively. The one or more actuators are located proximate to the first and second handles to enable movement and functionality control of the light that requires the use of only one hand.

18 Claims, 2 Drawing Sheets

EXAMINATION LIGHT WITH READILY ACCESSIBLE CONTROLS

FIELD

This invention relates to dental examination lights, and particularly dental examination lights bearing control functions.

BACKGROUND

Proper lighting while conducting dental procedures is of vital importance. Generally, dental lights include a head assembly mounted on an articulating structure to permit spatial repositioning of the light head as appropriate. One or more lamps are mounted within a housing of the assembly to emit light from a reflector, which then reflects the light to the oral cavity of a patient. One or more handles are typically provided on the light head to facilitate spatial reorientations of the head. The handles of a dental light may be integral with the light head.

Dental lights are typically specialized in design as compared to other medical related lights. The partially seated postures typical of a dental patient in a patient chair differ from the supine position typical of a medical patient lying on a table. Dental procedures impose a special requirement of providing excellent illumination for an oral cavity. A dental operatory differs in arrangement from a typical medical operatory; fewer personnel are involved in most dental procedures, and a dental provider thus tends to be more proactive in positioning the light. Also, most lights include switches or buttons on one of their sides that provide various functions such as on/off, dimming, color, etc.

A dental light is usually focused by positioning the reflector at the appropriate distance and orientation with respect to the oral cavity of a patient. Accordingly, the dental provider may find it necessary to grasp the handles associated with the light head from time to time during a procedure, particularly if the patient's head is repositioned. The handles are thereby contaminated.

The importance of maintaining sterile or aseptic conditions in a dental operatory has been increasingly well recognized. Methods and devices that have been adopted for maintaining clean conditions in a dental operatory are discussed by the introductory portions of U.S. Pat. No. 4,930,058.

SUMMARY

The inventors have realized that the control of conventional dental lights can be cumbersome for dental providers. The dental provider often must move a light in order to access control functions. This creates problems for the efficiency of the dental procedure or examination being performed, as the dental provider must reposition the light to the optimal position, which takes time and creates a troublesome inconvenience for the dental provider. Their focus and attention, which should be on the delicate dental procedure being performed, is instead averted to the purpose of moving and changing a setting of the light. Also, once an optimal position of the light is established, conventional lights require movement to access control functions. This creates an even greater inconvenience for those dental providers that have a dominant hand (e.g. left-handedness) that is opposite to where the controls are positioned on the light.

The inventors have devised a light that facilitates the quick and facile movement and functional control of the light. According to one embodiment, the invention pertains to a dental examination that includes a light source held by a frame. The frame has a frontal support member that has opposing lateral ends. On each end of the frontal support member are handles to facilitate movement of the light. In addition, the light has a first and second control panel located on the frontal support member that are located proximate to the handles at their respective ends. The control panels are ideally located such that they are readily accessible by the hand of the dental provider that is used to move the light. Having the control panels on the frontal support member also provides frontal visual access to the controls thereby allowing them to be seen with minimal movement by the dental provider. Dental providers often must position themselves leaning over the patient. Dental providers will be able to move this light embodiment and actuate any controls with minimal repositioning of their bodies.

Furthermore, having the handle in close proximity to the control panel provides a one location interface by the operator. This simplifies cleaning, as it reduces the number of human contact surfaces.

BRIEF DESCRIPTION OF THE DRAWINGS

The invention is explained in the following description in view of the drawings that show.

DETAILED DESCRIPTION

Figure 1:
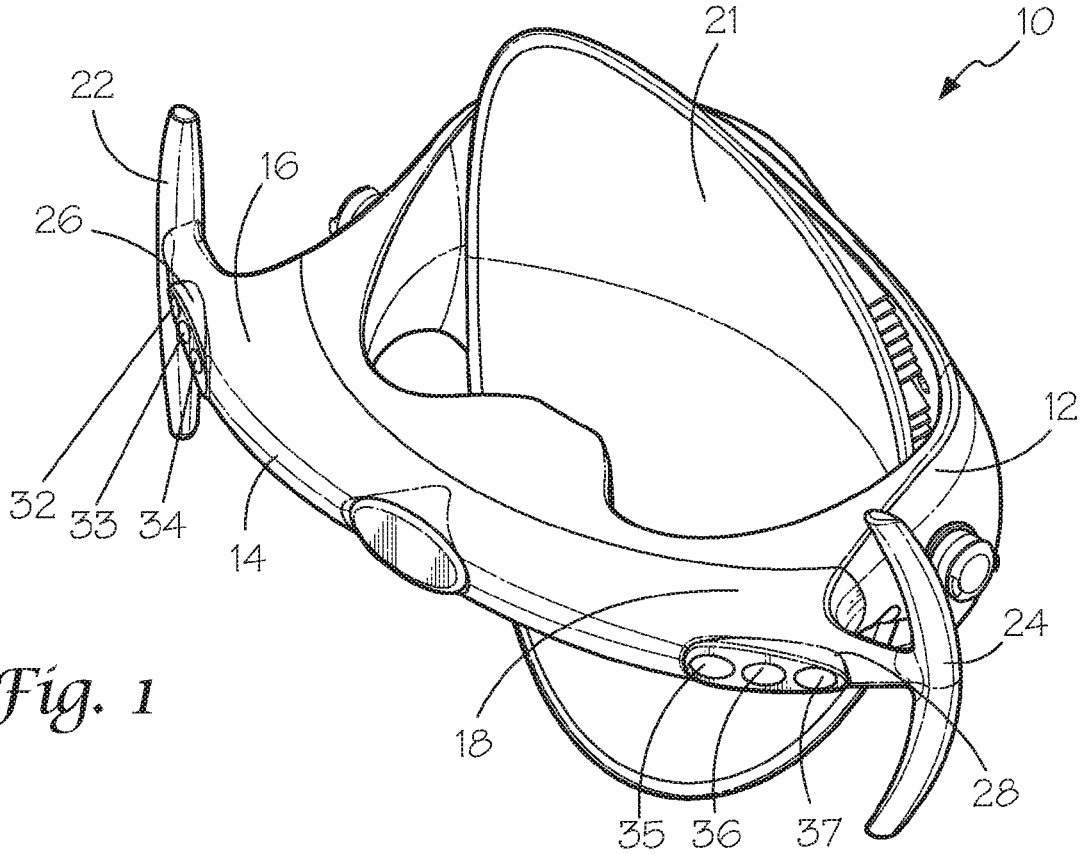
FIG. 1 represents a perspective of a dental examination light embodiment having dual control panels.
Figure 2:
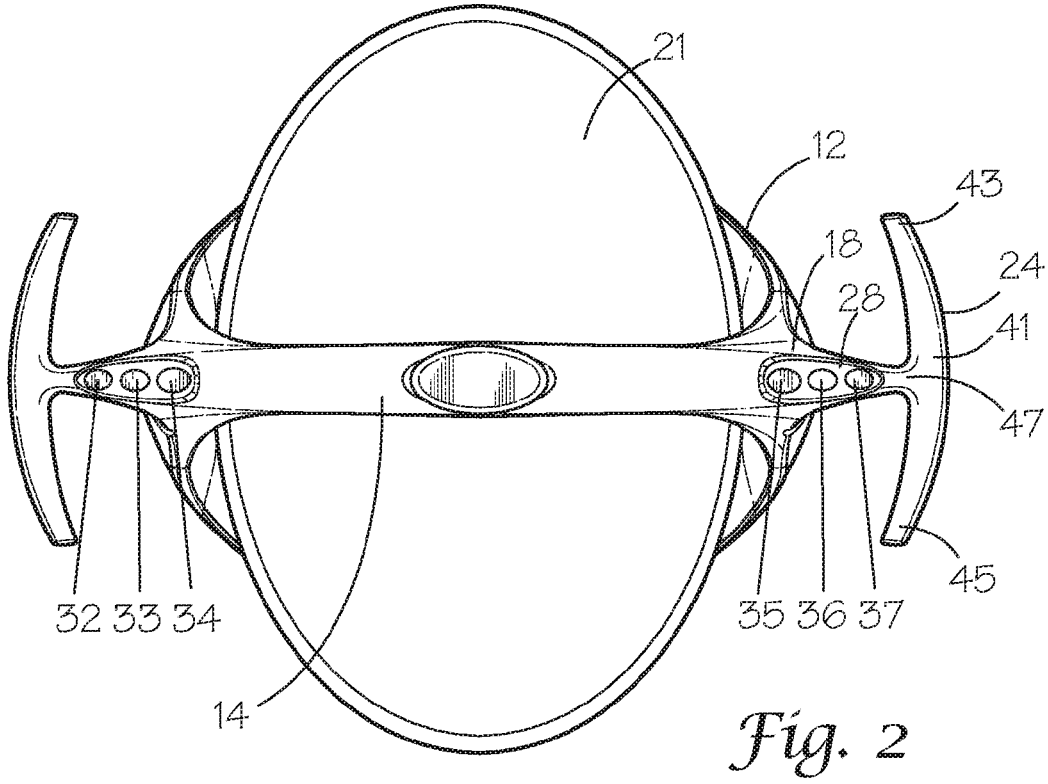
FIG. 2 represents a frontal view of the dental examination light embodiment shown in FIG. 1.

FIG. 1 shows a side view and FIG. 2 shows a frontal view of an examination light 10 embodiment. The examination light 10 has a frame 12 that holds and supports a light source 21. Positioned in front of the light source is a front support member 14 of the frame 12. The front support member 14 has a generally horizontal elongate body with a first lateral end 16 and second lateral end 18. Associated on each first and second lateral ends 16, 18 are a first and second handle 22, 24, respectively. As shown, the handles are integrated with the front support member 14, however, those skilled in the art will readily appreciate that the handles could be a separate piece attached to the frontal support member 14, or an arrangement of possible integration and attachment.

Disposed on the front surface of the frontal support member 14 are a first control panel 26 and a second control panel 28. The first and second control panels comprise a set of actuators 32-34 and 35-37, respectively, that allow for controlling functionality of the light by the operator. As shown, the actuators 32-37, represent buttons that are controlled by depressing with a finger or thumb of an operator. However, in view of the teachings herein, the actuators could take any number of suitable forms, including, but not limited to, buttons, slide switches, dials, toggles, heat sensors, motion sensors, and the like, or some combination thereof. The control panels and/or actuators of embodiments of the invention, may disposed at said first lateral end 16 and second lateral end 18, respectively, meaning they are closer to the respective lateral end than the other lateral end.

As shown in FIGS. 1 and 2, the control panels 26, 28 are located proximate to the handles 22, 24 on their respective ends 16, 18 so as to enable the operator to move the light with one hand and interface with the actuators 32-34 or 35-37 with the same hand. In a specific embodiment, the control panels are positioned such that the operator may interface with the actuators while a portion of their hand remains on the handle. In a more specific embodiment, the control panels are located such that they may interface with the actuators with their thumb while one or more of their other fingers has contact with the handle. In even more specific embodiments, the actuator farthest removed from the handle on the respective end is 0.5-8.0 inches away from the handle. In another embodiment, the farthest removed actuator is 1-6 inches, and all ¼ inch increments in between, away from the handle.

The light sources for use with embodiment 10 may include one or more high-powered LEDs emitting radiation having one or more wavelengths in a visible spectrum, which inherently possess a long life and have reduced maintenance requirements. The spectrum of emitted light from a lamp can be fixed in a range to reduce emitted UV wavelengths, thereby affording improved working time for a clinician to work with UV-cured adhesives or composites. The emitted light from certain desirable LED sources inherently has a reduced component of waves near the infrared spectrum, thereby resulting in greatly reduced heat output from the front of the lamp. The reduced heat output enhances a dental patient's comfort while that patient is in the illuminated target area of a lamp, and reduces tissue drying (e.g. in a dental operatory).

LED light sources may be selected for their emitted spectrum, and mixed in combination within a lamp to produce a desired lamp output intensity and/or color. Different color LEDs may be disposed at selected locations in a lamp to form, in combination, a lamp output having a certain color. The intensity of the light source's output and color mixing options are controllable by interfacing the actuators by the operator.

The handles 22, 24 of the light 10 are shown as comprising an arcuate elongated body 41 with an axis positioned in a generally vertical orientation. The elongated body 41 has a top end 43 and bottom end 45 and is associated with the frontal support member 14 at a position 47 between said top and bottom ends. Those skilled in the art will appreciate that numerous other handle configurations could be implemented in view of the teachings herein. It is noted that for most of the alternative handle configurations useful with the light embodiment 10, being arranged so as to enable interfacing with the actuators while a portion of the hand remains in contact with the alternate handle configuration is desired.

Figure 3:
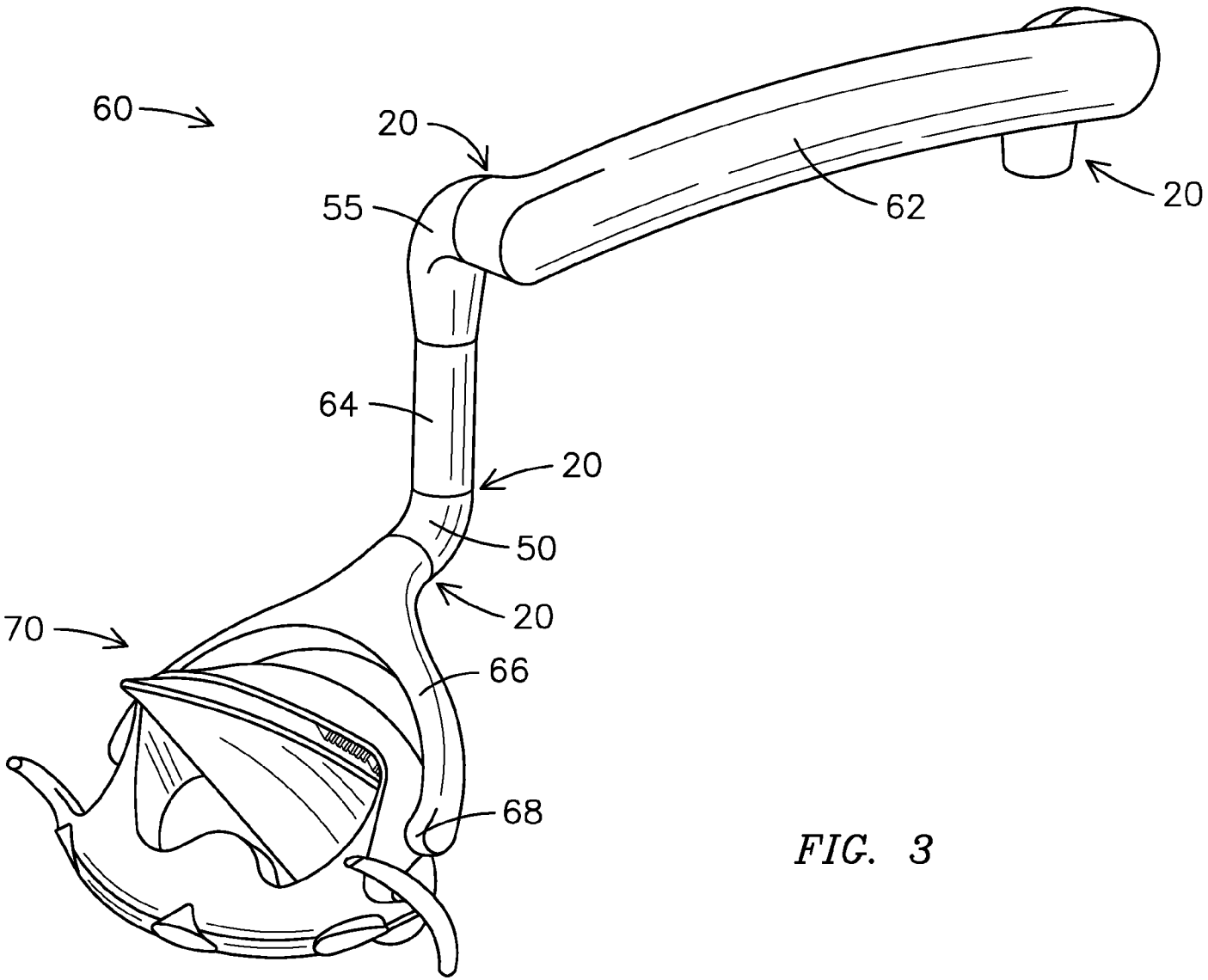
FIG. 3 is a perspective view of a dental examination light supported on an articulated arm.

FIG. 3 shows a dental examination light 70 pivotally mounted at 68 in a yoke arm segment 66 of an articulated arm assembly 60. The articulated arm assembly 60 also comprises segments 62, 64 and elbows 50, 55. The articulated arm assembly 60 has four suggested joint locations 20 for a pivot bearing, thereby providing multiple axes of arm movement.

While one or more embodiments of the present invention have been shown and described herein, such embodiments are provided by way of example only. Variations, changes and substitutions may be made without departing from the invention herein. Accordingly, it is intended that the invention be limited only by the spirit and scope of the appended claims. The teachings of all references cited herein are incorporated in their entirety to the extent not inconsistent with the teachings herein.

What is claimed is:

1. A dental examination light movable by an operator, said dental examination light comprising: a light source; a frame for holding said light source, said frame comprising a frontal support member that comprises a first lateral end and a second lateral end on opposing sides of said frontal support member; an arm assembly comprising at least one arm segment associated with said frame, wherein said arm assembly provides spatial movement of said frame; a first handle associated with said frontal support member at said first end; a second handle associated with said frontal support member at said second end; at least one first actuator for interfacing with said operator for controlling a function of said light source, said at least one first actuator disposed at said first lateral end; and at least one second actuator for interfacing with said operator for controlling a function of said light source; said at least one first actuator and said at least one second actuator are proximate to said first and second handles, respectively, so as to be accessible by said operator while at least a portion of one of said operator's hands is on said first or second handles;

wherein said at least one first actuator is located proximate to said first handle such that said first actuator may be contacted by a thumb of said operator when one or more fingers of said operator are in contact with said first handle, and said at least one second actuator is located proximate to said second handle such that said second actuator may be contacted by a thumb of said operator when one or more fingers of said operator are in contact with said second handle.

2. The light of claim 1, wherein said at least one first actuator is disposed on a first control panel disposed on said frontal support member.

3. The light of claim 2, wherein said at least one first actuator comprises a plurality of first actuators that are disposed on said first control panel.

4. The light of claim 1, wherein said at least one second actuator is disposed on a second control panel disposed on said frontal support member.

5. The light of claim 4, wherein said at least one second actuator comprises a plurality of second actuators that are disposed on said second control panel.

6. The light of claim 1, wherein said at least one first actuator and said at least one second actuator control the same functionality of said light.

7. The light of claim 1, wherein said at least one first or second actuator comprises an actuator for controlling an intensity of said light, activating or deactivating said light, or changing a color temperature of said light.

8. The light of claim 1, wherein said first and second handles comprise an arcuate elongated, generally cylindrical body with a top end and a bottom end, said first and second handles associating with said frontal support member at a location between said top and bottom ends.

9. The light of claim 1, wherein said frontal support member comprises an elongated body that comprises a generally horizontal longitudinal axis.

10. The light of claim 1, wherein said first and second handles are between about 0.5 and about 8 inches away from said at least one first actuator and said at least one second actuator, respectively.

11. The light of claim 10, wherein said first and second handles are between about 1 and about 6 inches, and all 0.25 inch increments in between, from said at least one first actuator and said at least one second actuator, respectively.

12. A method for moving and controlling a function of a light comprising:

obtaining a light comprising a light source; a frame for holding said light source, said frame comprising a frontal support member that comprises a first lateral end and a second lateral end on opposing sides of said frontal support member; at least one arm associated with said frame, wherein said at least one arm provides spatial movement of said frame; a first handle associated with said frontal support member at said first end; a second handle associated with said frontal support member at said second end; at least one first actuator for interfacing with said operator for controlling a function of said light source, said at least one first actuator disposed at said first lateral end; and at least one second actuator for interfacing with said operator for controlling a function of said light source;

holding said first handle of said light with one hand; moving said light by applying force to said light via said first handle;

controlling a function of said light by contacting said at least one first actuator with a finger or thumb of said one hand, while at least a portion of said one hand is in contact with said handle;

wherein said at least one first actuator is located proximate to said first handle such that said first actuator may be contacted by a thumb of said operator when one or more fingers of said operator are in contact with said first handle, and said at least one second actuator is located proximate to said second handle such that said second actuator may be contacted by a thumb of said operator when one or more fingers of said operator are in contact with said second handle.

13. A dental examination light movable by an operator, said dental examination light comprising:

a light source;

a frame for holding said light source, said frame comprising a frontal support member that comprises a first lateral end and a second lateral end on opposing sides of said frontal support member;

an arm assembly comprising at least one arm segment associated with said frame, wherein said arm assembly provides spatial movement of said frame;

a first handle associated with said frontal support member at said first end;

a second handle associated with said frontal support member at said second end; a first control panel disposed on said first end, said first control panel comprising at least one actuator for interfacing with said operator for controlling a function of said light source; and a second control panel disposed on said second end, said second control panel comprising at least one actuator for interfacing with said operator for controlling a function of said light source; wherein said first and second control panels are between about 0.5 and about 8 inches away from said first handle and said second handle, respectively;

wherein said at least one first actuator is located proximate to said first handle such that said first actuator may be contacted by a thumb of said operator when one or more fingers of said operator are in contact with said first handle, and said at least one second actuator is located proximate to said second handle such that said second actuator may be contacted by a thumb of said operator when one or more fingers of said operator are in contact with said second handle.

14. The light of claim 13, wherein said first and second panels are between about 1 and about 6 inches, and all 0.25 inch increments in between, from said at least one first handle and said at least one second handle, respectively.

15. The light of claim 13, wherein said at least one actuator comprises a button, slide switch, toggle, heat sensor or motion sensor.

16. The light of claim 13, wherein said at least one first or second actuator comprises an actuator for controlling an intensity of said light, activating or deactivating said light, or changing a color temperature of said light.

17. A dental examination light movable by an operator, said dental examination light comprising:

a light source;

a frame for holding said light source, said frame comprising a frontal support member that comprises a first lateral end and a second lateral end on opposing sides of said frontal support member;

an arm assembly comprising at least one arm segment associated with said frame, wherein said arm assembly provides spatial movement of said frame;

at least one handle associated with said frontal support member at either said first lateral end or said second lateral end;

at least one actuator for interfacing with said operator for controlling a function of said light source, said at least one actuator being proximate to said at least one handle, so as to be accessible by said operator while at least a portion of one of said operator's hands is on said at least one handle;

wherein said at least one first actuator is located proximate to said first handle such that said first actuator may be contacted by a thumb of said operator when one or more fingers of said operator are in contact with said first handle, and said at least one second actuator is located proximate to said second handle such that said second actuator may be contacted by a thumb of said operator when one or more fingers of said operator are in contact with said second handle.

18. The light of claim 17, wherein said first and second panels are between about 1 and about 6 inches, and all 0.25 inch increments in between, from said at least one first actuator and said at least one second actuator, respectively.

* * * * *